US011732613B2

(12) United States Patent
Pilichowska et al.

(10) Patent No.: US 11,732,613 B2
(45) Date of Patent: Aug. 22, 2023

(54) APPARATUS FOR REMOVAL OR INSTALLATION OF TURBINE BLADE

(71) Applicants: General Electric Company, Schenectady, NY (US); Atlantic Plant Maintenance, Inc., Pasadena, TX (US)

(72) Inventors: Joanna Sylwia Pilichowska, Warsaw (PL); Piotr Krzysztof Dzieciol, Warsaw (PL); Szymon Perkowski, Warsaw (PL); Daniel John Moroney, Sketty Swansea (GB); Eric Wayne Hendricks, Soperton, GA (US)

(73) Assignees: General Electric Company, Schenectady, NY (US); Atlantic Plant Maintenance, Inc., Pasadena, TX (US)

( * ) Notice: Subject to any disclaimer, the term of this patent is extended or adjusted under 35 U.S.C. 154(b) by 0 days.

(21) Appl. No.: 17/399,370

(22) Filed: Aug. 11, 2021

(65) Prior Publication Data

US 2022/0235675 A1 Jul. 28, 2022

(30) Foreign Application Priority Data

Jan. 22, 2021 (PL) ..... 436737

(51) Int. Cl.
*F01D 25/28* (2006.01)
*F01D 5/00* (2006.01)

(52) U.S. Cl.
CPC ..... *F01D 25/285* (2013.01); *F01D 5/005* (2013.01); *F05D 2220/30* (2013.01);
(Continued)

(58) Field of Classification Search
CPC ..... F01D 25/285; F01D 5/30; F01D 5/3007; F01D 5/005; B23P 19/02; B23P 19/04
See application file for complete search history.

(56) References Cited

U.S. PATENT DOCUMENTS 4,096,614 A * 6/1978 Brungard ..... F01D 25/285 29/244
7,128,537 B2 10/2006 Anner et al.
(Continued)

FOREIGN PATENT DOCUMENTS

EP 1614856 A1 1/2006
EP 2733307 A1 5/2014
(Continued)

OTHER PUBLICATIONS

PCT Application No. PCT/US2022/070212, Notice of International Search Report dated Jun. 3, 2022, 502422-WO-3 (GEEN-1271-PCT), 11 pages.
(Continued)

*Primary Examiner* — Christopher J Besler
(74) *Attorney, Agent, or Firm* — James Pemrick; Charlotte Wilson; Hoffman Warnick LLC

(57) ABSTRACT

An apparatus for removing or installing a turbine blade from a turbine of a turbomachine is disclosed. The apparatus can include: an operative head configured to engage an axial sidewall of a turbine blade base. An actuator is configured to move the operative head to selectively engage the axial sidewall of the turbine blade base and impart an axial force against the turbine blade base to remove or install the turbine blade. A support gantry is configured to position the actuator substantially vertically above the turbine blade in position in the turbomachine. Among other advantages, the support gantry allows adjustment of the apparatus for different turbines, and use of the head on more than one stage of any given turbine.

13 Claims, 8 Drawing Sheets

(52) U.S. Cl.
CPC ..... *F05D 2230/60* (2013.01); *F05D 2230/70* (2013.01); *F05D 2230/80* (2013.01); *F05D 2240/24* (2013.01)

(56) References Cited

U.S. PATENT DOCUMENTS

| | | | | |
|---|---|---|---|---|
| 7,455,505 | B2 | 11/2008 | Hartmann et al. | |
| 9,381,602 | B2 | 7/2016 | Holmes et al. | |
| 2010/0162546 | A1* | 7/2010 | Kalmar | F01D 25/285 29/244 |
| 2015/0128417 | A1 | 5/2015 | Laborde | |
| 2018/0126502 | A1 | 5/2018 | Wojtowicz et al. | |
| 2018/0142560 | A1* | 5/2018 | Wojtowicz | F01D 25/285 |

FOREIGN PATENT DOCUMENTS

| | | | |
|---|---|---|---|
| EP | 3318716 | A1 | 5/2018 |
| EP | 3327250 | A1 | 5/2018 |
| WO | 2012167824 | A1 | 12/2012 |

OTHER PUBLICATIONS

PCT Application No. PCT/US2022/070212, Notification of Transmittal of International Preliminary Report on Patentability (Chapter II of the Patent Cooperation Treaty); dated Dec. 22, 2022; 502422-WO-3 (GEEN-1271-PCT), 7 pages.

* cited by examiner

APPARATUS FOR REMOVAL OR INSTALLATION OF TURBINE BLADE

BACKGROUND

The present disclosure relates generally to the removal of turbine blades in turbomachine assemblies, and more particularly, to an apparatus for removing or installing a turbine blade from a turbine in a turbomachine.

Rotors for turbines of turbomachines are often machined from large forgings. Rotor wheels cut from the forgings are typically slotted to accept the bases of turbine blades for mounting. As the demand for greater turbine output and more efficient turbine performance continues to increase, larger and more articulated turbine blades are being installed in turbomachines. Dynamic properties that affect the design of these latter stage turbine blades include the contour and exterior surface profile of the various blades used in a turbomachine, which may affect the fluid velocity profile and/or other characteristics of operative fluids in a system. In addition to the contour of the blades, other properties such as the active length of the blades, the pitch diameter of the blades and the high operating speed of the blades in both supersonic and subsonic flow regions can significantly affect performance of a system. Damping and blade fatigue are other properties that have a role in the mechanical design of the blades and their profiles. These mechanical and dynamic response properties of the blades, as well as others, all influence the relationship between performance and surface profile of the turbine blades. Consequently, the profile of the latter stage turbine blades often includes a complex blade geometry for improving performance while minimizing losses over a wide range of operating conditions.

The application of complex blade geometries to turbine blades, particularly latter stage turbine blades, presents certain challenges in assembling and disassembling these blades on a rotor wheel. For example, adjacent turbine blades on a rotor wheel are typically connected together by cover bands or interlocking tip shrouds positioned around the outer periphery of the blades to confine a working fluid within a well-defined path and to increase the rigidity of the blades. These interlocking shrouds may impede the direct assembly and disassembly of blades positioned on the rotor wheel. In addition, inner platforms of these blades and their dovetail slots are often angled in relation to the axis of the turbine rotor wheel that they are mounted in, which also can impede their assembly on the rotor wheel. In many cases, the turbine blades must be removed one at a time. The working environment in which the turbine blades operate can cause, for example, corrosion, thermal distortion, etc., that can require significant force to disassemble the blades.

One approach to removal or installation of the turbine blades requires forcing the blades axially by application of force against another part of the turbine, e.g., an adjacent rotor wheel. Application of force to an adjacent structure can potentially cause damage to that structure. Another approach mounts a removal or installation apparatus to a part of the half-joint casing of the turbine in a cantilevered fashion, i.e., at three o'clock or nine o'clock relative to the axis of the turbine. This latter approach requires rotating the turbine to position each turbine blade at the three o'clock or nine o'clock position, such that the turbine blade extends generally horizontally from the rotor wheel in a cantilevered manner. Consequently, the weight of the turbine blade works against its removal or installation by applying a torque to the dovetail connection at the base of the turbine blade, requiring more axial force to remove the turbine blade. In addition, it is very challenging to support the turbine blade during removal and/or installation so that it does not fall or rotate in a manner that potentially damages the turbine blade, the rotor wheel, the half-joint casing or other parts of the turbine. Where the turbine blade is mounted in an angled dovetail slot, i.e., relative to the axis of the turbine, the rotor must be turned as the turbine blade is inserted or pulled out of position, which is extremely challenging where the blade is generally horizontal.

SUMMARY

An aspect of the present disclosure provides an apparatus to remove or install a turbine blade from a turbine of a turbomachine, the apparatus comprising: an operative head configured to engage an axial sidewall of a turbine blade base; an actuator configured to move the operative head to selectively engage the axial sidewall of the turbine blade base and impart an axial force against the turbine blade base to remove or install the turbine blade; and a support gantry configured to position the actuator substantially vertically above the turbine blade in position in the turbomachine.

Another aspect of the disclosure provides an apparatus to remove or install a turbine blade from a turbine, the apparatus comprising: an operative head configured to engage an axial sidewall of a turbine blade base, the operative head including an arm; an actuator configured to move the operative head to selectively engage the axial sidewall of the turbine blade base and impart an axial force against the turbine blade base to remove the turbine blade from the turbine or install the turbine blade in the turbine; and a support gantry configured to position the actuator substantially vertically above the turbine blade, wherein the actuator further includes: a mount member configured to couple to the support gantry; and a fastening member configured to selectively position the mount member between: a first state in which the mount member is axially and pivotally fixed to an axially-extending support of the support gantry and the arm extends substantially vertically adjacent a first stage of a plurality of turbine blade stages, and a second state in which the mount member is pivotable relative to the axially-extending member to position the arm radially outside of any turbine blade on the turbine, and axially movable along the axially-extending member of the support gantry, wherein, in the second state, the actuator is movable along the axially-extending member for positioning relative to a different second stage of the plurality of turbine blades.

Another aspect of the present disclosure relates to a method for installation or removal of a turbine blade from a turbine of a turbomachine, the method comprising: mounting an apparatus to a portion of a turbomachine, the apparatus including an operative head configured to engage an axial sidewall of a turbine blade base, an actuator configured to move the operative head to selectively engage the axial sidewall of the turbine blade base and impart an axial force against the turbine blade base, and a support gantry configured to position the actuator substantially vertically above the turbine blade; and mechanically actuating the turbine blade base relative to the turbomachine by applying the axial force against the turbine blade base through the operative head, such that the turbine blade base transfers into or out of a rotor wheel of a first stage of turbine blades.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

Figure 1:
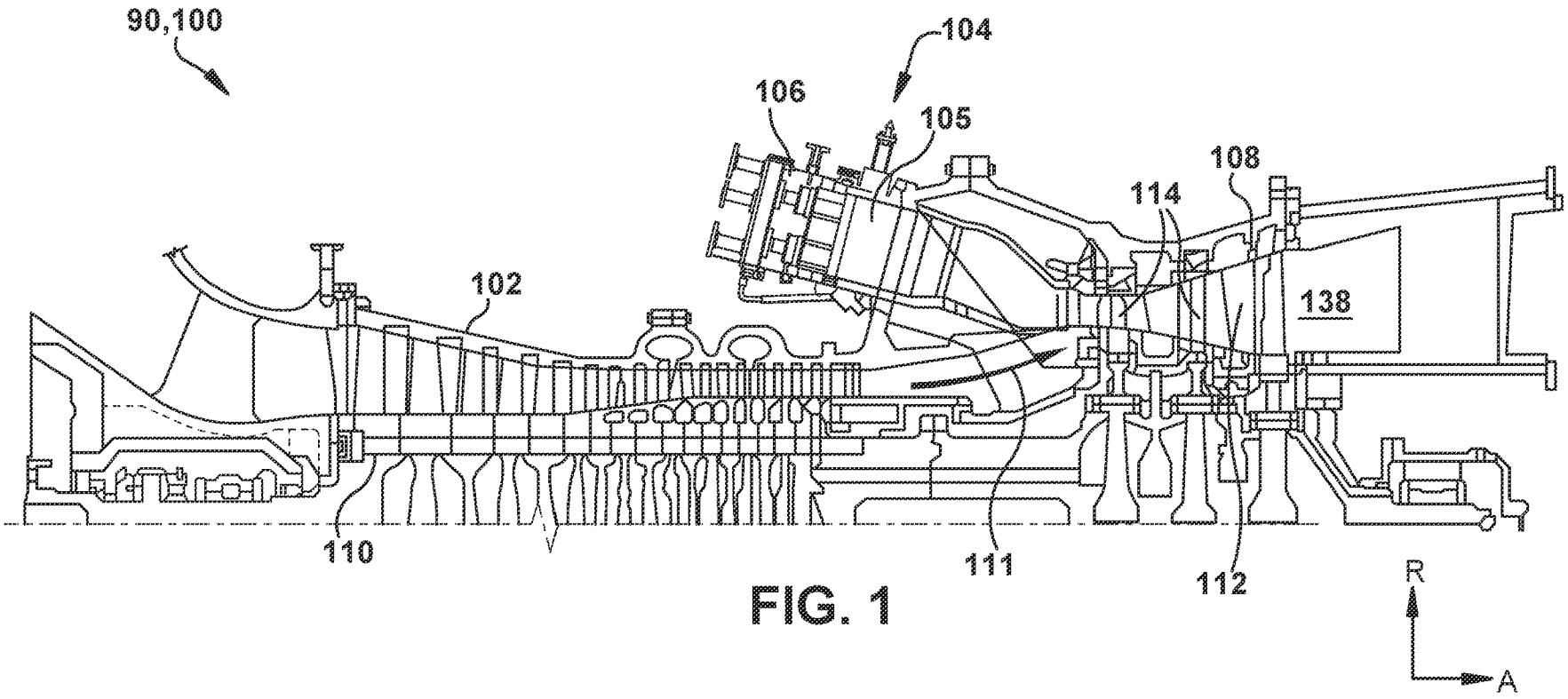
FIG. 1 is a schematic view of a conventional turbomachine.

It is noted that the drawings of the disclosure are not necessarily to scale. The drawings are intended to depict only typical aspects of the disclosure and therefore should not be considered as limiting the scope of the disclosure. In the drawings, like numbering represents like elements between the drawings.

DETAILED DESCRIPTION

As an initial matter, in order to clearly describe the subject matter of the current disclosure, it will become necessary to select certain terminology when referring to and describing relevant machine components within a turbomachine. To the extent possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

In addition, several descriptive terms may be used regularly herein, and it should prove helpful to define these terms at the onset of this section. These terms and their definitions, unless stated otherwise, are as follows. As used herein, "downstream" and "upstream" are terms that indicate a direction relative to the flow of a fluid, such as the working fluid through the turbine or, for example, the flow of air through the combustor or coolant through one of the turbine's components. The term "downstream" corresponds to the direction of flow of the fluid, and the term "upstream" refers to the direction opposite to the flow (i.e., the direction from which the flow originates). The terms "forward" and "aft," without any further specificity, refer to directions, with "forward" referring to the front or compressor end of the engine, and "aft" referring to the rearward section of the turbomachine.

In addition, several descriptive terms may be used regularly herein, as described below. The terms "first", "second", and "third" may be used interchangeably to distinguish one component from another and are not intended to signify location or importance of the individual components.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components but do not preclude the presence or addition of one or more other features, integers, steps, operations, elements, components, and/or groups thereof "Optional" or "optionally" means that the subsequently described event or circumstance may or may not occur or that the subsequently describe component or element may or may not be present, and that the description includes instances where the event occurs or the component is present and instances where it does not or is not present.

Where an element or layer is referred to as being "on," "engaged to," "connected to" or "coupled to" another element or layer, it may be directly on, engaged to, connected to, or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

As denoted in these Figures, the "A" axis represents axial orientation (along the axis of a rotor of a turbomachine). As used herein, the terms "axial" and/or "axially" refer to the relative position/direction of objects along axis A, which is substantially parallel (i.e., within +/−3°) with the axis of rotation of the turbomachine (in particular, the rotor section thereof). As further used herein, the terms "radial" and/or "radially" refer to the relative position/direction of objects along axis (R), which is substantially perpendicular with axis A and intersects axis A at only one location. It is often required to describe parts that are disposed at differing radial positions with regard to a center axis. For example, if a first component resides closer to the axis than a second component, it will be stated herein that the first component is "radially inward" or "inboard" of the second component. If, on the other hand, the first component resides further from the axis than the second component, it may be stated herein that the first component is "radially outward" or "outboard" of the second component. Additionally, the terms "circumferential" and/or "circumferentially" refer to the relative position/direction of objects along a circumference (C) which surrounds axis A but does not intersect the axis A at any location. In figures that depict a two-dimensional view, circumference C may be omitted for clarity.

The term "transfer" or "axial transfer" refers to the process of moving (e.g., by sliding motion) a component such as a blade from one position to another, such as to or from a dovetail slot of a rotor wheel. Thus, embodiments of the present disclosure discussed herein can allow turbine blades to be installed within or removed from a rotor wheel of a turbine by transferring one or more turbine blades.

Although removal of turbine blades is shown more specifically in the drawings, it is understood that the various embodiments described herein may be operable to install and/or remove turbine blades at a rotor wheel without modifying the various components and/or process methodologies discussed. Embodiments of the present disclosure also provide methods of installing turbine blades by using various apparatuses discussed herein and/or similar assemblies.

Embodiments of the disclosure provide an apparatus for removing or installing a turbine blade from a turbine of a turbomachine, and a related method. The apparatus can include an operative head configured to engage an axial sidewall of a turbine blade base. An actuator is configured to move the operative head to selectively engage the axial sidewall of the turbine blade base and impart an axial force against the turbine blade base to remove or install the turbine blade. A support gantry is configured to position the actuator substantially vertically above the turbine blade in position in the turbomachine. Among other advantages, the support gantry allows a wide range of adjustment of the apparatus for, for example, different angles, different turbines with different mounting locations. The apparatus also allows operation on more than one stage of any given turbine without unbolting the apparatus, saving time. In addition, due to the vertical positioning of the apparatus, the apparatus requires less axial force to transfer the turbine blade and allows for a safer install or removal of the blade by supporting it from above. The apparatus can be operated almost entirely remotely, adding more safety.

Referring to the drawings, FIG. 1 is a schematic view of an illustrative turbomachine 90 in the form of a combustion turbine or gas turbine (GT) system 100 (hereinafter, "GT system 100"). GT system 100 includes a compressor 102 and a combustor 104. Combustor 104 includes a combustion region 105 and a fuel nozzle assembly 106. GT system 100 also includes a turbine 108 and a common compressor/turbine shaft 110 (hereinafter referred to as "rotor 110"). In one non-limiting example, GT system 100 is a 9HA.01 engine, commercially available from General Electric Company, Greenville, S.C. The present disclosure is not limited to any one particular GT system and may be implanted in connection with other engines including, for example, the other HA, F, B, LM, GT, TM and E-class engine models of General Electric Company and engine models of other companies. Further, the teachings of the disclosure are not necessarily applicable to only a GT system and may be applied to other types of turbomachines, e.g., steam turbines, jet engines, compressors, etc.

Figure 2:
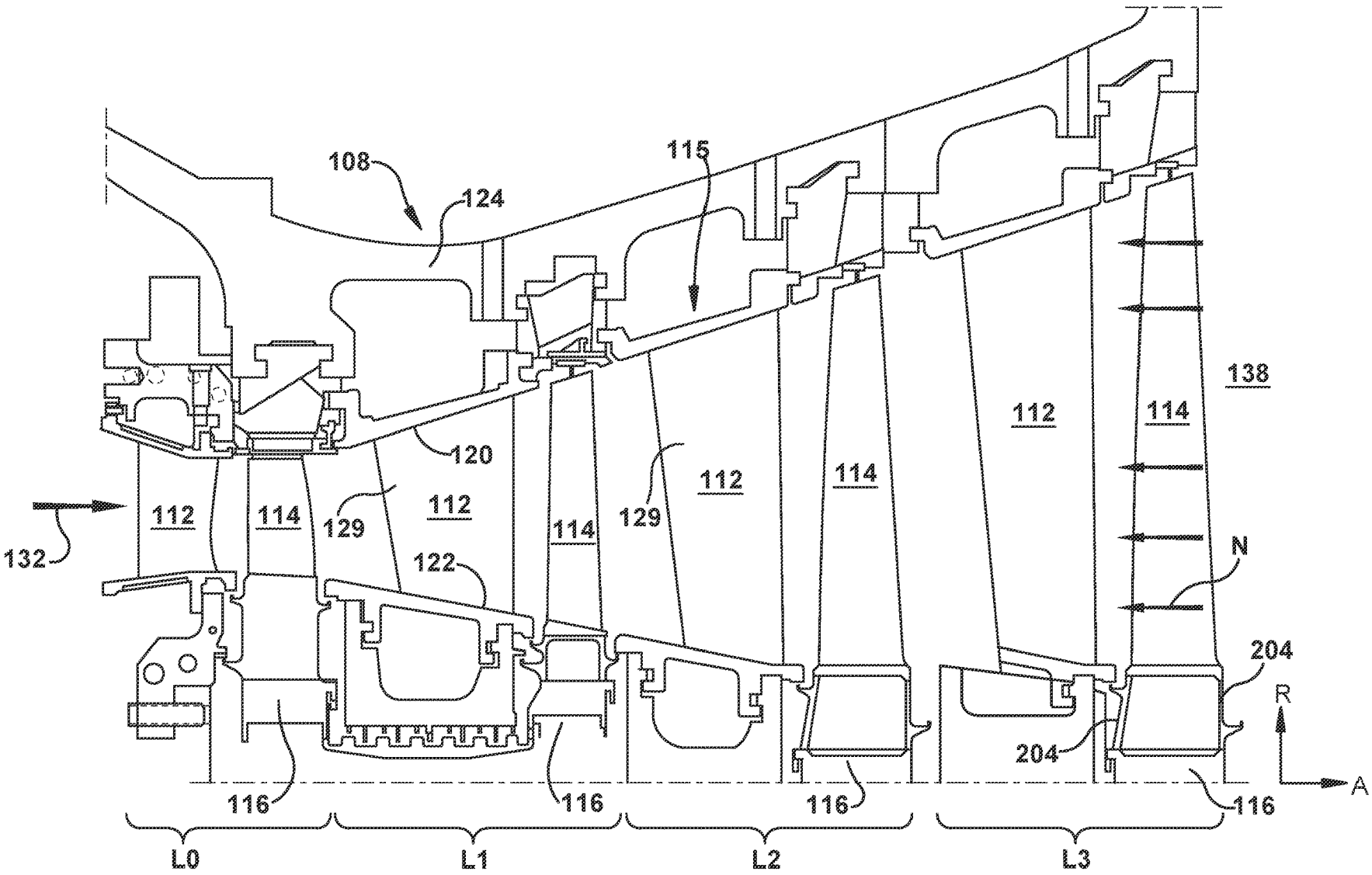
FIG. 2 is a cross-sectional view of a number of turbine blade stages of an illustrative turbomachine.

FIG. 2 shows a cross-section view of an illustrative portion of turbine 108 with four stages L0-L3 that may be used with GT system 100 in FIG. 1. The four stages are referred to as L0, L1, L2, and L3. Stage L0 is the first stage and is the smallest (in a radial direction) of the four stages. Stage L1 is the second stage and is the next stage in an axial direction. Stage L2 is the third stage and is the next stage in an axial direction. Stage L3 is the fourth, last stage and is the largest (in a radial direction). It is to be understood that four stages are shown as one example only, and each turbine may have more or less than four stages.

A set of stationary vanes or nozzles 112 cooperate with a set of rotating blades 114 to form each stage L0-L3 of turbine 108 and to define a portion of a flow path through turbine 108. Rotating blades 114 in each set are coupled to a respective rotor wheel 116 that couples them circumferentially to rotor 110. That is, a plurality of rotating blades 114 are mechanically coupled in a circumferentially spaced manner to each rotor wheel 116. A static nozzle section 115 includes a plurality of stationary nozzles 112 circumferentially spaced around rotor 110. Each nozzle 112 may include at least one endwall (or platform) 120, 122 connected with an airfoil 129. In the example shown, nozzle 112 includes a radially outer endwall 120 and a radially inner endwall 122. Radially outer endwall 120 couples nozzle(s) 112 to a casing 124 of turbine 108.

In operation, air flows through compressor 102, and compressed air is supplied to combustor 104. Specifically, the compressed air is supplied to fuel nozzle assembly 106 that is integral to combustor 104. Fuel nozzle assembly 106 is in flow communication with combustion region 105. Fuel nozzle assembly 106 is also in flow communication with a fuel source (not shown in FIG. 1) and channels fuel and air to combustion region 105. Combustor 104 ignites and combusts fuel. Combustor 104 is in flow communication with turbine 108 within which gas stream thermal energy is converted to mechanical rotational energy. Turbine 108 is rotatably coupled to and drives rotor 110. Compressor 102 also is rotatably coupled to rotor 110. In the illustrative embodiment, there is a plurality of combustors 104 and fuel nozzle assemblies 106. In the following discussion, unless otherwise indicated, only one of each component will be discussed. At least one end of rotor 110 may extend axially away from turbine 108 and may be attached to a load or machinery (not shown), such as, but not limited to, a generator, a load compressor, and/or another turbine.

Figure 3:
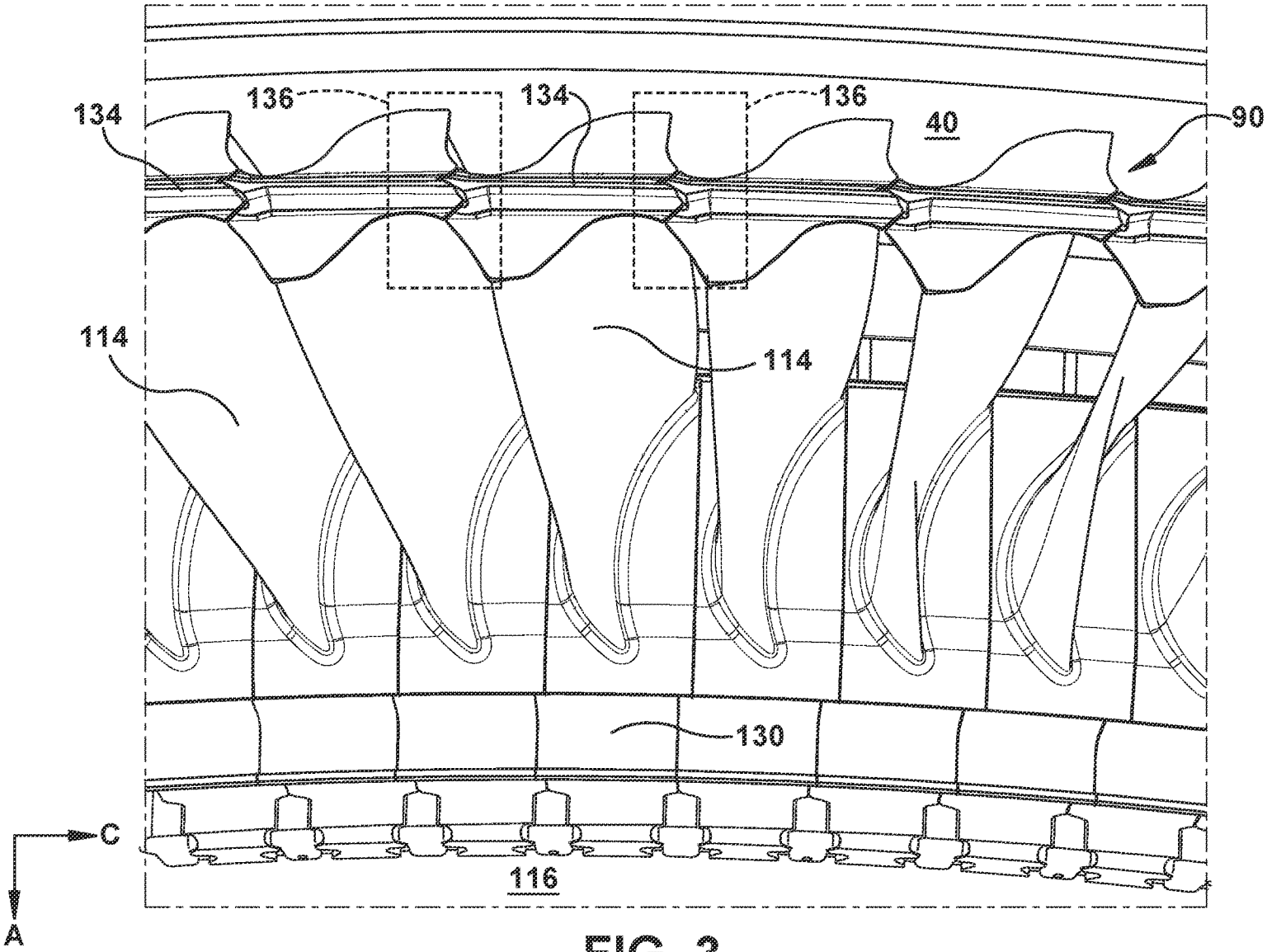
FIG. 3 is a perspective view of turbine blades coupled to a rotor wheel, and including an interlocking shroud interface.

Turning to FIG. 3, a plurality of blades 114 in a selected stage of blades are shown arranged in a row and mounted circumferentially adjacent to each other on rotor wheel 116. Blades 114 may be designed for continued circumferential engagement with each other during operation and when subjected to relatively high loads. An example form of mechanical engagement between circumferentially adjacent blades 114 is shown in FIG. 3, and embodiments of the present disclosure may be effective for installing and removing blades 114 designed for this arrangement or similar arrangements. Each blade 114 can be mechanically coupled to and mounted on rotor wheel 116 through a turbine blade base 130 including, e.g., a dovetail shape designed to fit within and engage a complementary slot within rotor wheel 116. As shown in FIG. 3, blades 114 can extend from turbine blade base 130 with varying profiles and/or contours for accommodating a flow of fluid 132 (FIG. 2) or other fluids across each blade 114. A radial end of blade 114 can include a shroud portion 134 in the form of a mutually engaging, substantially identical block or plate formed and/or mounted on the tip of each blade 114. Once each blade 114 is installed on rotor wheel 116, the engaging blocks or plates of each shroud portion 134 can form a substantially continuous tip shroud element, e.g., a substantially continuous, annular body configured to direct a flow around rotor 110 (FIG. 1).

Referring to FIGS. 2 and 3 together, shroud portion 134 of each blade 114 can include, e.g., an interlocking profile 136 (FIG. 3 only) for circumferential engagement with shroud portions 134 of adjacent blades 114. In some examples, interlocking profile 136 may include a Z-shape, a V-shape, a zig-zag path with multiple transition points, a curvilinear surface, a complex geometry including straight-faced and curved surfaces, etc. However embodied, interlocking profile 136 can inhibit axial sliding of each blade 114 relative to rotor wheel 116 after each blade 114 has been installed. In addition, blades 114 may be positioned directly between turbine 108 of turbomachine 90 and an adjacent flow path 138 (FIG. 2), e.g., an exhaust hood or diffusor section of turbomachine 90 (FIG. 1). As shown in FIG. 2, each blade 114 may be designed for installation or removal substantially along the direction of axial path N. Interlocking profile 136 can be advantageous during operation of turbomachine 90, e.g., by maintaining the relative position of each blade 114 relative to each other and to rotor wheel 116. However, interlocking profile 136 may reduce the ability for one or more blades 114 to be installed or removed from a location directly between two other blades 114 during manufacture or servicing.

Embodiments of the present disclosure can mitigate these properties of interlocking profile 136, e.g., by imparting an axially-oriented force to install or remove blades 114. In some embodiments, the installed or removed blade 114 can further be subjected to mechanical vibrations. Such vibrations, e.g., can impart oscillating motion to blade 114 and allow axial movement of blade 114 despite various impeding factors, e.g., corrosion, that may impede movement. Various embodiments for imparting axial force, and/or mechanical vibration against blade(s) 114 are discussed herein. As will be described, embodiments of the present disclosure can include an apparatus mounted on fixed structure 140, such as an exhaust hood 142 (FIG. 4) (e.g., a panel or strut thereof) of turbomachine 90, a casing 124 of turbomachine 90 such as an outer shell, half-joint casing 150 (FIG. 4), and/or other turbomachine components capable of having various structural features mounted thereon. In contrast to current approaches, the apparatus is vertically, radially above the turbine blades.

Figure 4:
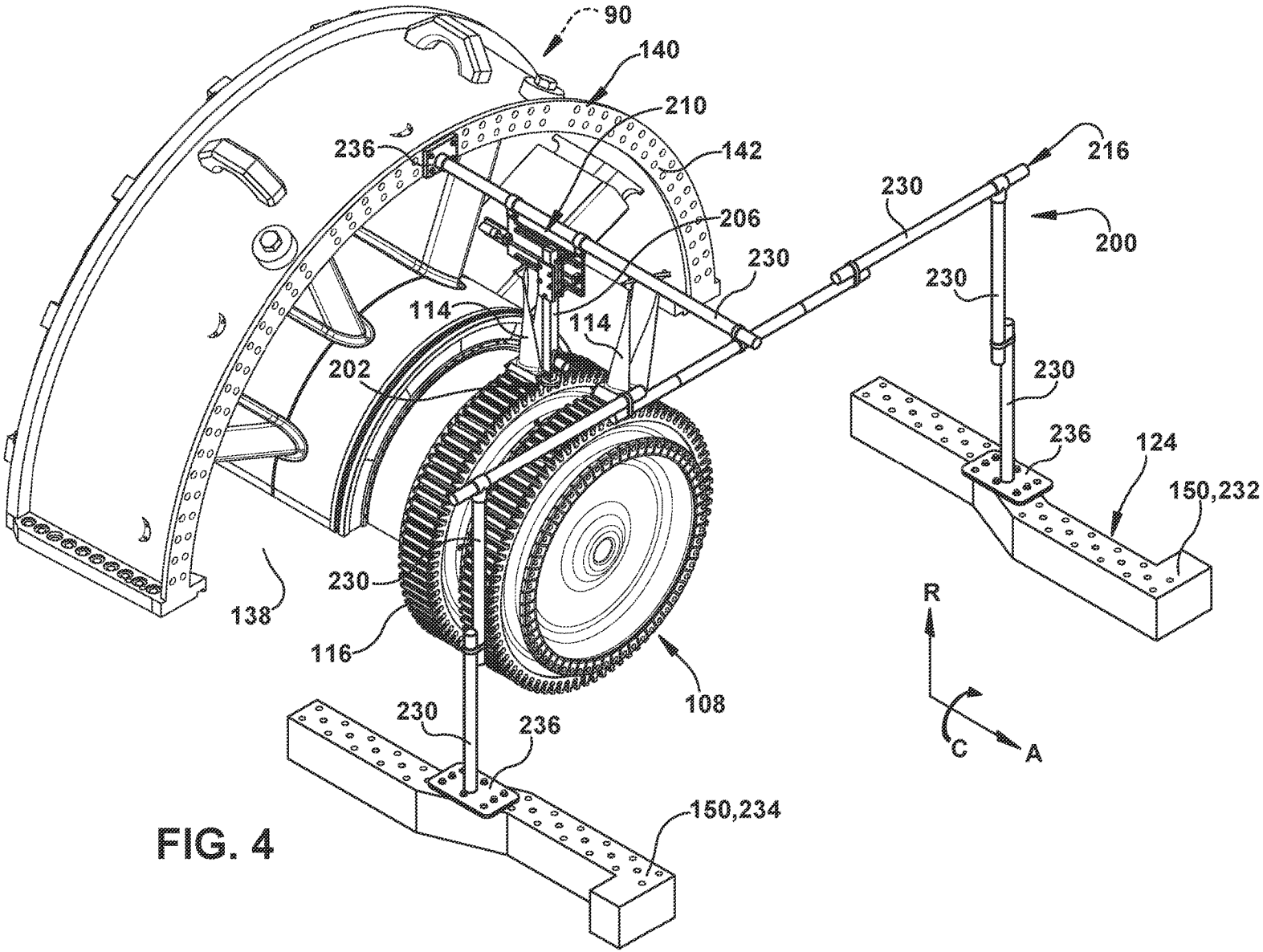
FIG. 4 is a perspective view of an apparatus for removing and/or installing a turbine blade according to embodiments of the disclosure.
Figure 5:
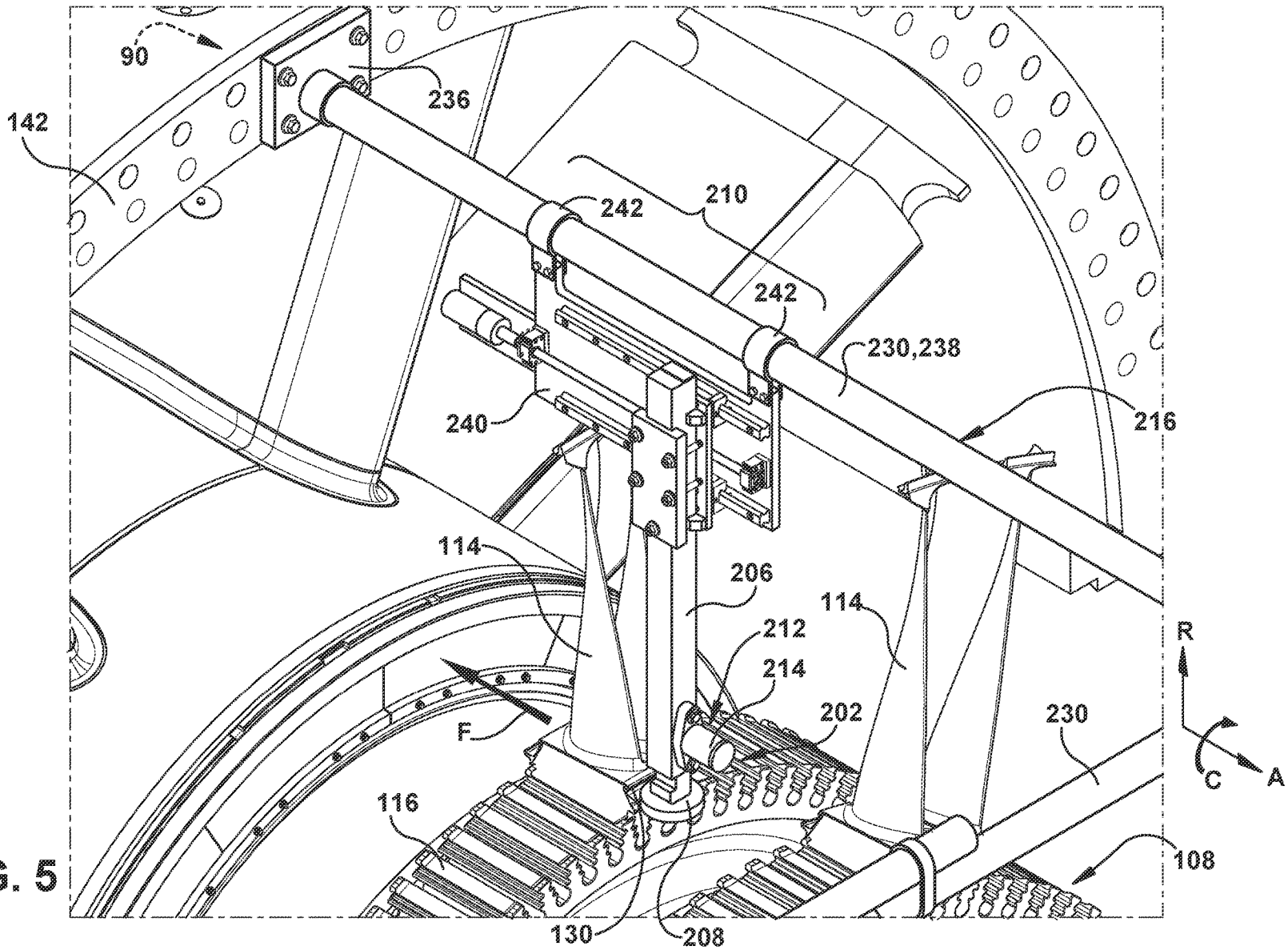
FIG. 5 is an enlarged perspective view of an apparatus for removing and/or installing a turbine blade according to embodiments of the disclosure.

Referring to FIGS. 4 and 5 together, an apparatus 200 for installing and/or removing turbine blades 114 at turbine blade base 130 is shown according to embodiments of the present disclosure. Turbine blade base 130 may include a root of turbine blade 114 or may include any portion of turbine blade 114 configured to couple to rotor wheel 116. FIG. 4 shows a perspective view of apparatus 200, FIG. 5 shows an enlarged partial perspective view of apparatus 200 to better illustrate various components thereof, and FIG. 6 shows an enlarged perspective view of an actuator 210 of the apparatus.

For purposes of description, blade(s) 114 illustrated in the following drawings may include last-stage (e.g., L3 (FIG. 1)) blades in turbomachine 90, which may include the same or similar features shown in FIGS. 2-3 and described elsewhere herein. Last-stage blades 114 may differ from other blades 114 in turbomachine 90, e.g., by being positioned where conventional vibrating assemblies and/or actuating devices for installing and removing blades 114 cannot be used, or are impractical. However, as will be described, apparatus 200 is advantageously adjustable to remove or install blade(s) 114 from a number of stages within turbomachine 90 without being moved. In addition, apparatus 200 can be located to operate on any stage of blades in practically any turbine 108. Embodiments of apparatus 200 and other method or apparatus embodiments described herein, can be used to install or remove blade(s) 114 while being mechanically coupled to one or more portions of turbomachine 90.

Apparatus 200 generally includes an operative head 202 movable by an actuator 210 supported by a support gantry 216.

Figure 6:
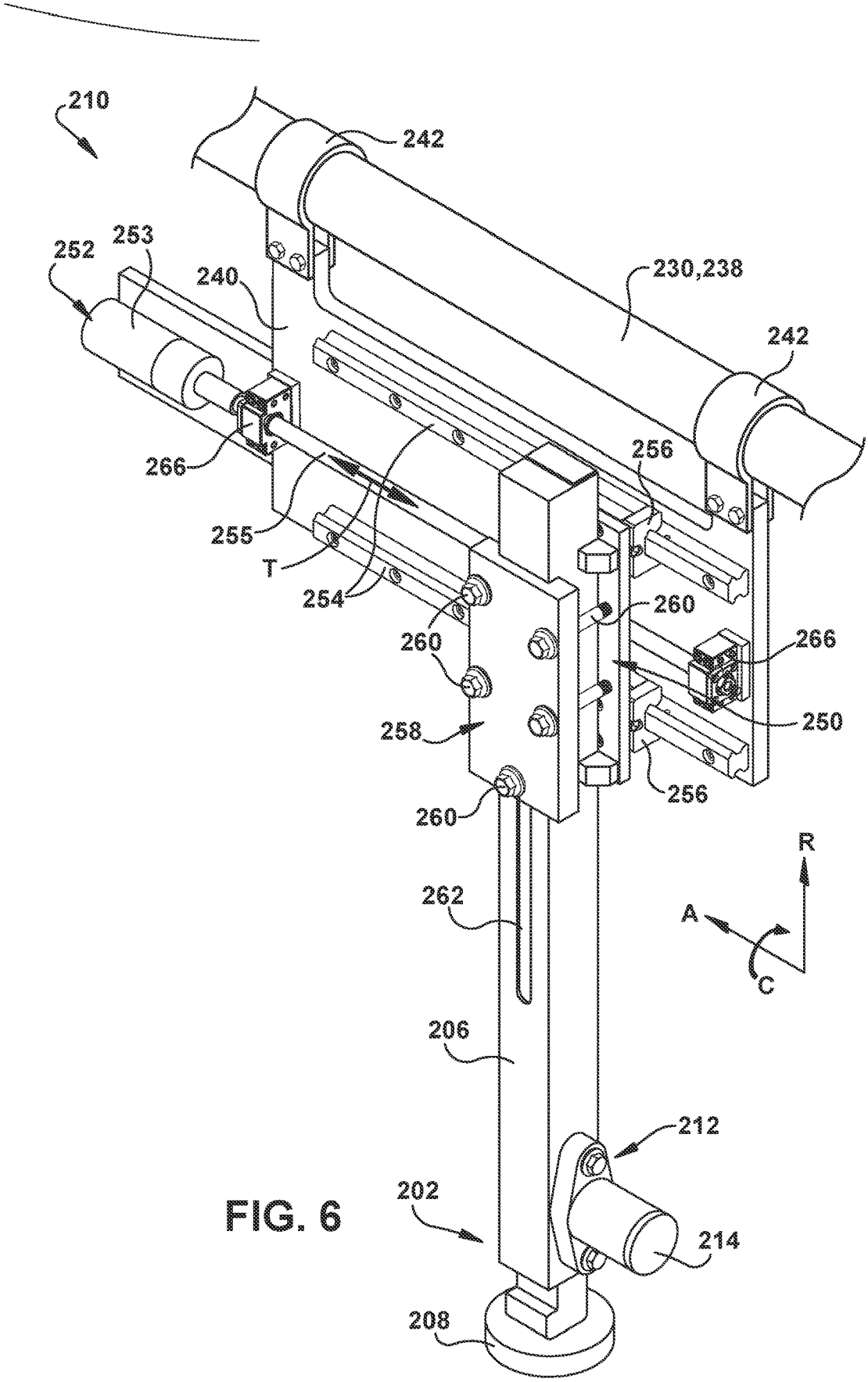
FIG. 6 is an enlarged perspective of an actuator of the apparatus for removing and/or installing a turbine blade according to embodiments of the disclosure.

Referring to FIGS. 4-6, apparatus 200 includes operative head 202 configured to engage an axial sidewall 204 (FIGS. 2, 5 and 6) of turbine blade base 130. Operative head 202 is shaped to impart an axial force F against turbine blade base 130. Operative head 202 can be shaped and/or positioned to engage axial sidewall 204 of turbine blade base 130 while applying mechanical force thereto in an axial direction, i.e., generally parallel to the axis of the turbomachine. Axial sidewall 204 may face upstream or downstream depending on where room is available to install or remove a respective blade 114 from rotor wheel 116. In one embodiment, operative head 202 includes an arm 206, which may extend vertically when operatively coupled to an actuator 210, i.e., the arm is a vertically extending arm. Arm 206 may have any length necessary to properly position operative head 202, i.e., end of arm 206, to engage axial sidewall 204 of turbine blade base 130. While one length of arm 206 is illustrated, arm 206 may be selected from a set of different length arms, which may be provided as part of apparatus 200 so it can be used with any radial length of turbine blade 114, and/or a variety of different stages of a given turbine 108. Alternatively, as shown in FIG. 6, vertically extending arm 206 may be length adjustable. It can be made length adjustable using any solution, for example, by changing its vertical position relative to actuator 210 using a coupling member 258 and/or plate couplers 260 (e.g., bolts, screws, etc.) joining the arm to coupling members 258—see adjustment slot 262. While a slot 262 is shown, any form of selectable opening(s) can also be used. Operative head 202 may include any structure to engage axial sidewall 204, e.g., at end of arm 206 adjacent axial sidewall 204. That is, operative head 202 can be provided in the form of any now known or later-developed instrument for imparting axial force, and perhaps vibrational oscillation, against components mechanically engaged thereto. Operative head 202 can be embodied as, e.g., one or more vibrating hammers, plates, cylinders, rollers, etc. In one embodiment, operative head 202 may include an engagement element 208 (FIG. 6) configured to engage axial sidewall 204 of turbine blade base 130, and slide along axial sidewall 204 of turbine blade base 130 while the rotor rotates.

Operative head 202 may also include a vibrating assembly 212 including a vibratory drive mechanism 214 coupled to arm 206. In some implementations, vibratory drive mechanism 214 can include a pneumatic motor configured to generate mechanical vibrations and/or other forms of movement using, for example, compressed air fed to vibrating assembly 212, e.g., through a fluid source. Vibratory drive mechanism 214 can alternatively include, or be embodied as, an electric motor, combustion engine, and/or other currently-known or later developed instruments for producing mechanical work, coupled with, e.g., an eccentric weight vibrator system. Vibrating assembly 212 can be adjustably coupled to and/or positioned directly on arm 206 using any now known solution, e.g., fasteners, welding, etc. Vibrating assembly 212 may be adjustably mounted to arm 206 to allow positioning anywhere along a length of arm 206.

Apparatus 200 also includes support gantry 216 configured to position actuator 210 substantially vertically above turbine blade 114, while turbine blade 114 is in position in turbine 108 of turbomachine 90. As used herein, "substantially vertical" indicates +/−10° from vertical. Support gantry 216 can include any now known or later developed bridge-like overhead structure with a platform supporting actuator 210, and having sufficient strength to withstand the motive forces applied thereto. Support gantry 216 may mount to any fixed structure 140. In certain embodiments, support gantry 216 may mount to a portion of turbomachine 90 in which turbine blade 114 is positioned. As illustrated in FIG. 4, an outer shell, upper half-joint casing (not shown) can be removed, leaving an outer shell, lower half-joint casing 150. Here, turbine 108 including turbine blade 114 is in position for operation of turbine 108, excepting for the remove of any outer shell, upper half-joint casing. The portion of turbomachine 90 to which support gantry 216 mounts may include fixed structure 140 that is, for example, adjacent to turbine 108, and/or in which turbine 108 is positioned, e.g., lower half-joint casing 150. In the example shown, support gantry 216 mounts to opposing sides 232, 234 of lower half-joint casing 150 in which turbine 108 is positioned, and an exhaust hood 142 adjacent to turbine 108. While support gantry 216 has been shown mounted in a particular manner in the drawings, it is emphasized that it can be mounted to any variety of alternative fixed structures 140, e.g., power plant floor, other casings, other structure adjacent turbine 108, cranes within a power plant, among many other options. Any mounting mechanism 236 capable of fixedly attaching support gantry 216 to fixed structure 140 may be used, e.g., bolted or clamped mounting plates, etc.

As illustrated, in certain embodiments, support gantry 216 may include a plurality of adjustable support members 230 configured to accommodate a plurality of different turbines 108, i.e., different sized turbines having blade stages at different distances and with different outer radii than illustrated. In the non-limiting example shown, support members 230 may include scaffolding members similar to those used in construction applications. Any number of support members 230 may be used, and may be coupled together in any now known or later developed fashion, e.g., clamps, fasteners, threaded couplings, etc. In any event, support members 230 are capable of positioning actuator 210 at any lateral position above turbine 108, and any axial position along axis A of turbine 108. For purposes described herein, in certain embodiments, at least one support member 238 extends axially, i.e., parallel to axis A of turbine 108.

To effectuate movement of operative head 202, apparatus 200 can include actuator 210 mechanically coupled to operative head 202, i.e., arm 206, such that actuation of actuator 210 causes operative head 202 and arm 206 to move relative to turbine blade base 130. More particularly, actuator 210 is configured to move the operative head 202 to selectively engage axial sidewall 204 of turbine blade base 130 and impart an axial force F against turbine blade base 130 to remove or install turbine blade 114. As shown best in FIGS. 5 and 6, actuator 210 can include a mount member 240 configured to couple to support gantry 216. Mount member 240 may include any structural member capable of coupling to an axially-extending support member 238 of support gantry 216. In certain embodiments, mount member 240 takes the form of a plate; however, other forms are also possible. Mount member 240 can include any number of couplers 242 in the form of, e.g., pipe clamps, or other forms of couplers appropriate for the shape and dimensions of axially-extending support member 238. Couplers 242 may extend outward from mount member 240 to engage one or more portions of axially-extending support member 238. Couplers 242 can be selectively fastened and unfastened to remove actuator 210 from support gantry 216, or allow movement of actuator 210 relative to support gantry 216. More particularly, couplers 242 can be selectively fastened and unfastened to allow actuator 210 to be moved axially relative to turbine blade 114 thereunder, e.g., along axially-extending support member 238, to allow desired axially positioning of operative head 202. In this manner, apparatus 200 can be used to remove or install turbine blades 114 on numerous stages of turbine 108 without having to move support gantry 216 or other parts of apparatus 200. Axially-extending support member 238 can have any length required to allow movement to as many stages of turbine 108 as desired with a single mounting of apparatus 200.

Actuator 210 also includes a slide system 250 configured to slidably move operative head 202 relative to mount member 240 (axially), and hence, turbine blade 114. Actuator 210 also includes a linear actuator 252 configured to selectively move slide system 250 axially relative to mount member 240 to apply the axial force F to axial sidewall 204 of turbine blade base 130. Slide system 250 may include one or more axial guides 254 to enable movement of operative head 202 with arm 206 relative to mount member 240 in at least one direction, e.g., along line T. Axial guides 254 may be embodied as slidable couplings such as rails, raceways, slots, etc., and/or may include alternative forms of structure permitting movement in one direction such as gear bearings, rack-and-pinion assemblies, threaded housings, and/or other mechanical bearings. Where axial guides 254 are embodied as a rail or other slidable bearing, a pair of slidable couplings 256 may each be slidably connected to and/or mounted on respective axial guides 254. Slidable couplings 256 may take the form of trolleys, wheels, gears, and/or other sliding components or bearings designed to enable movement of one component relative to another, e.g., along the direction of arrow T. In alternative scenarios where axial guides 254 are in the form of a gear bearing or alternative component for providing a slidable coupling between two mechanically engaged elements, slidable couplings 256 may be substituted for, e.g., wheels, gears, threaded members, etc., for providing movement substantially in the direction of axial axis A. A coupling member 258 may be provided as a unitary housing shaped to engage an outer surface profile of arm 206, or alternatively may be coupled to one surface of arm 206. In this case, another coupling member 258 can be coupled to another surface of arm 206, with plate couplers 260 (e.g., bolts, screws, rivets, etc.) joining the two coupling members 258 together. As will be recognized, a variety of alternative mechanisms to couple arm 206 to slide system 250 may also be employed.

An operator may further control the position of operative head 202 and arm 206 relative to mount member 240 with additional components included within and/or operably connected to actuator 210. For example, linear actuator 252 may include any form of drive mechanism 253 in the form of, e.g., a mechanical motor, electrical motor, pneumatic motor, etc., that can produce and transmit mechanical work to move operative head 202 and arm 206 across axial guide(s) 254. In the non-limiting example illustrated, linear actuator 252 includes a worm gear 255 that interacts with coupling member 258 to move operative head 202 and arm 206. Linear actuator 252 can be coupled to mount member 240, e.g., through a bearing 266 shaped to receive a portion of linear actuator 252 therein. Bearing 266 can be positioned at opposing ends of mount member 240 to allow for a worm gear 255 to rotate freely in order to move a slide system 250. Slide system 250, worm gear 255 and/or drive mechanism 252 may be coupled using any necessary adapters (not shown). Each bearing 266 can be mounted on a portion of mount member 240, e.g., by being mechanically affixed thereto through conventional fasteners such as bolts, screws, rivets, etc.

Figure 7:
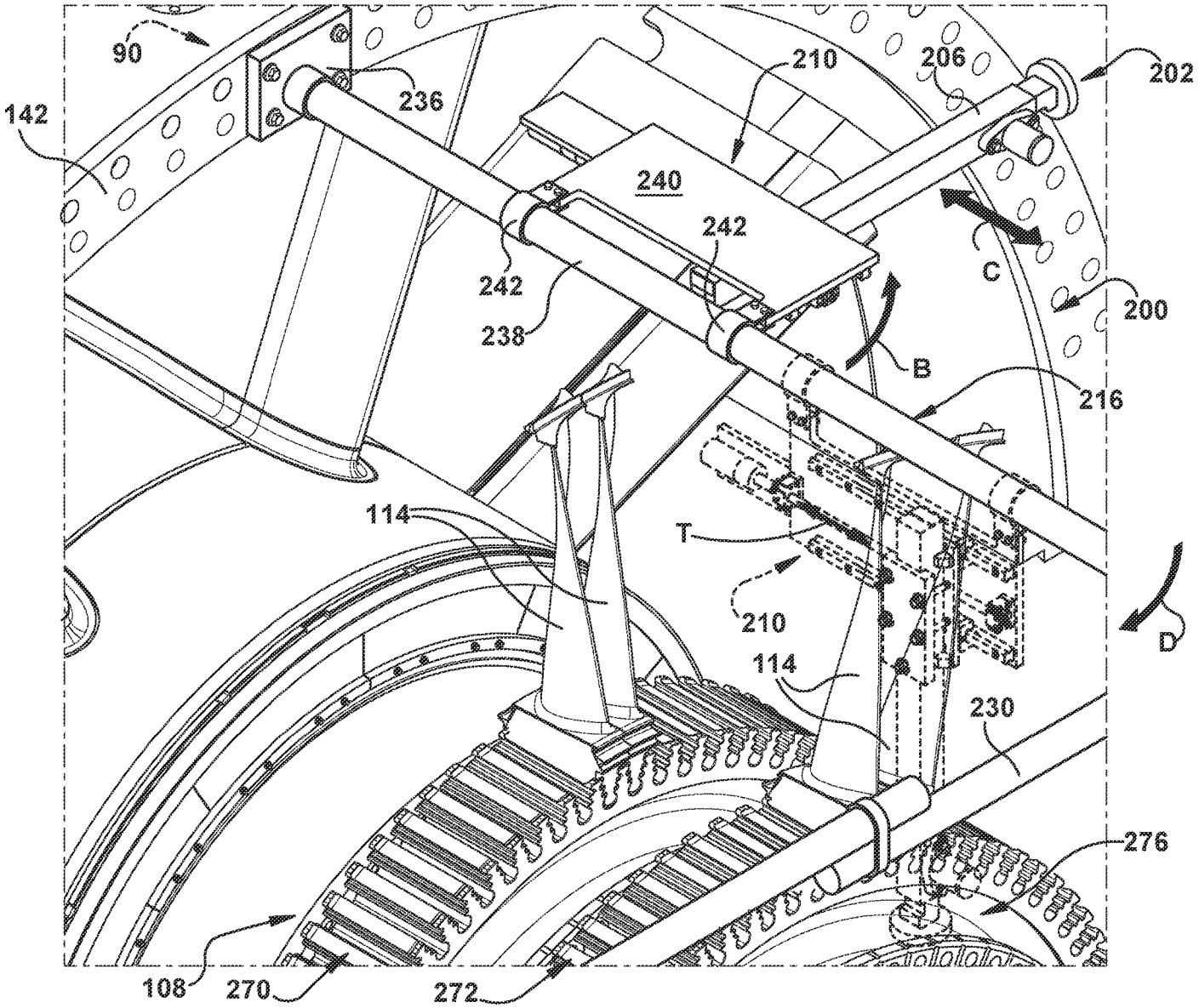
FIG. 7 is a perspective view of the apparatus for removing and/or installing a turbine blade in an adjustment state, according to embodiments of the disclosure.

In addition to positioning actuator 210 axially on axially-extending support member 238, as described herein, coupler 242 is also configured to selectively position mount member 240 of actuator 210 between two states. A first, operative state, as shown in FIGS. 4 and 5, is one in which mount member 240 is axially and pivotally fixed to axially-extending support member 238 of support gantry 216. Here, arm 206 extends substantially vertically adjacent a first stage 270 of a plurality of turbine blade stages (see plurality of emptied rotor wheels 116). This state is an operative state of apparatus 200 in which actuator 210 can be actuated to remove or install turbine blades 114 in the selected rotor wheel 116 for the selected blade stage. FIG. 7 shows another, second adjustment state in which couplers 242 have been released sufficiently to allow mount member 240 to be pivotable relative to axially-extending support member 238 (see arrow B) to position arm 206 radially outside of any turbine blade 114 on turbine 108, and axially movable along axially-extending support member 238 of support gantry 216. In the second state, actuator 210 is movable along axially-extending support member 238 for positioning relative to a different second stage 272 of plurality of turbine blades 114 (see arrow C). Once in a new, desired position, actuator 210 can be rotated back so that operative head 202 is in a location to apply axial force F to axial sidewall 204 of a selected turbine blade base 130 (see arrow D). In this manner, despite support gantry 216 not moving, apparatus 200 can operate on more than one stage, making removal or installing of turbine blades in a number of stages significantly faster and safer.

Figure 8:
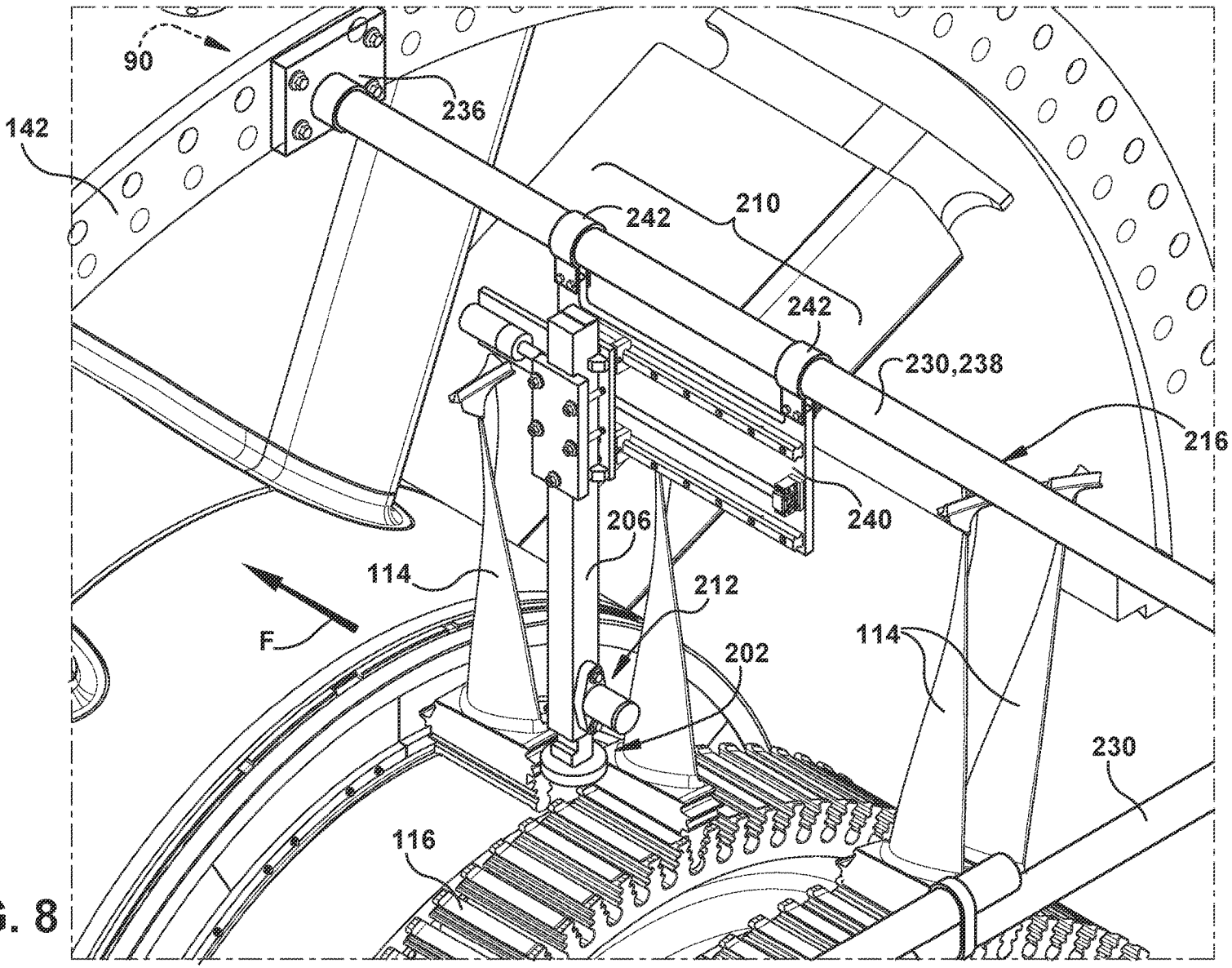
FIG. 8 is a perspective view of the apparatus for removing and/or installing a turbine blade in an operative state, according to embodiments of the disclosure.

In operation, a method for installation or removal of a turbine blade 114 from a turbine 108 of turbomachine 90 may include mounting apparatus 200, as described herein, to a portion of turbomachine 90. In one non-limiting example, mounting includes mounting support gantry 216 to opposing sides 232, 234 of half-joint casing 150 in which turbine 108 is positioned, and to exhaust hood 142 adjacent to turbine 108 in turbomachine 90. Operative head 202 may be substantially axially aligned with turbine blade base 130 of a selected blade 114. Using actuator 210, operative head 202 may be moved to engage operative head 202 of apparatus 200 with turbine blade base 130 (before actuating turbine blade base). As shown in FIG. 8, the method may further include mechanically actuating turbine blade base 130 relative to turbomachine 90 by applying axial force F against turbine blade base 130 through operative head 202 causing turbine blade base 130 to transfers into or out of rotor wheel 116 of a first stage of turbine blades 114. That is, operative head 202 under actuation by actuator 210 through arm 206 forces turbine blade 114 into or out of rotor wheel 116. In terms of installation, these actions can move blade 114 axially toward rotor wheel 116 such that blade 114 is installed between two other blades 114. In the case of removal, operative head 202 can contact and axially move blade 114 out of position between two adjacent blades 114, and out of rotor wheel 116. Both the removal and the installation process can be employed where the blades need to be "fanned out", meaning one has to remove the blades one by one, a bit at a time while also turning the rotor. Fanning out is necessary, for example, where a skewed dovetail or interlocking tip shrouds will not allow removal or installation of a single blade on its own. Optionally, vibrating assembly 212 may be coupled to operative head 202, e.g., via arm 206, of the apparatus, and turbine blade base 130 may be vibrated concurrently with applying axial force F. As shown in FIG. 8, the position of operative head 202 and arm 206 may be adjusted as operative head 202 vibrates and as mount member 240 remains stationary relative to lower half-joint casing 150.

Methods of installing and/or removing blade 114 may be particularly effective for installing or removing blades 114 which include shroud portion 134 configured to form an interlocking profile 136 (FIG. 3) with circumferentially adjacent blades 114. As shown best in FIG. 8, the use of arm 206 in apparatus 200 can allow a user to substantially align operative head 202 (with or without vibrating assembly 212) with a stage of turbine 108, regardless of turbine arrangement. As illustrate, apparatus 200 may alternatively be used to install or remove blades 114 other than last-stage blades, e.g., at a location positioned axially between stages 270, 272. Apparatus 200 can thus be used at any position of turbomachine 90 where conventional installation or apparatus have difficulty accessing blades 114.

Where a different stage of turbine blades is to be removed or installed, as shown in FIG. 7, the method may include first rotating actuator 210 so as to rotate arm 206 (and operative head 202) from a first operative position (FIGS. 4-5) adjacent rotor wheel 116 of first stage of turbine blades 114 to a position radially outside of any turbine blades 114 on turbine 108. As also shown in FIG. 7, actuator 210 may be axially moved along axially-extending support member 238 of support gantry 216 to an inoperative position (FIG. 7) in which arm 206 is radially outside of and axially over a space 276 adjacent a different, second stage 272 of turbine blades 114 of turbomachine 90. The different, second stage 272 can be any stage accessible by arm 206 and actuator 210 via axially-extending support member 238. Actuator 210 may then be rotated back again (arrow D in FIG. 7) so as to rotate arm 206 from the inoperative position to another operative position (dashed lines in FIG. 7) adjacent a different, second stage 272 of turbine blades 114. The mechanical actuating of turbine blade base 130 relative to turbomachine 90 by applying axial force F against turbine blade base 130 through operative head 202 can then be repeated for any number of turbine blades 114 in second stage 272. That is, such that turbine blade base 130 transfers into or out of rotor wheel 116 of different, second stage 272 of turbine blades 114.

Apparatus 200 can include one or more materials including and without limitation: metals, plastics, ceramics, and/or other materials adapted for use in the field of turbomachine installation or servicing.

Embodiments of the present disclosure can provide several technical and commercial advantages, some of which are discussed herein by way of example. Embodiments of the fixtures and methods discussed herein can provide substantially uniform manufacturing and/or servicing of turbine blades, such as those used in turbomachines. Embodiments of the present disclosure can also be employed for processes and/or events requiring at least partial disassembly of a turbomachine and/or stage, such as during the inspection of particular components (e.g., last-stage blades of a gas turbine). The various embodiments discussed herein can be operable to install or remove blades in relatively inaccessible locations, without necessitating partial or total deconstruction of adjoining components. The support gantry allows a wide range of adjustment of the apparatus for, for example, different angles and/or different turbines with different mounting locations. The apparatus also allows operation on more than one stage of any given turbine without unbolting the apparatus, saving time. In addition, due to the vertical positioning of the apparatus, the apparatus requires less axial force to transfer the turbine blade base and allows for a safer install or removal of the blade by supporting the blade from above. The apparatus can be operated almost entirely remotely, e.g., using any now known or later developed remote control systems. It is also understood that embodiments of the present disclosure can provide advantages and features in other operational and/or servicing contexts not addressed specifically herein.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples, including the best mode, and to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An apparatus configured for at least one of removing or installing a turbine blade from a turbine of a turbomachine while the turbine is positioned within a casing of the turbomachine, wherein the turbine is housed in the casing while the turbine is in operation and during use of the apparatus, the apparatus comprising:

an operative head configured to engage an axial sidewall of a turbine blade base;

a linear actuator configured to move the operative head to selectively engage the axial sidewall of the turbine blade base and impart an axial force against the turbine blade base for the at least one of removing or installing the turbine blade;

a mount member supporting the linear actuator;

a slide system connected to the mount member, the operative head, and the linear actuator, whereby the slide system is configured to slidably move the operative head relative to the mount member responsive to the linear actuator to apply the axial force;

a support gantry to which the mount member is attached, wherein the support gantry is capable of positioning the linear actuator substantially vertically above the turbine blade and in position in the turbomachine, the support gantry configured to mount to the casing in which the turbine is positioned for the removing or installing a turbine blade, wherein the operative head includes an arm operatively coupled to the linear actuator; and a coupler by which the mount member is attached to the support gantry, whereby the coupler is configured to selectively position the mount member between:

a first state in which the mount member is axially and pivotally fixed to an axially-extending support member of the support gantry and the arm is configured to extend substantially vertically adjacent a first stage of a plurality of turbine blade stages, and a second state in which the mount member is pivotable relative to the axially-extending support member to position the arm radially outside of any turbine blade on the turbine, and axially movable along the axially-extending support member of the support gantry, and wherein, in the second state, the linear actuator is movable along the axially-extending support member for positioning relative to a different second stage of the plurality of turbine blades.

2. The apparatus of claim 1, wherein the support gantry is configured to mount to a portion of the turbomachine in which the turbine blade is positioned, the portion of the turbomachine including a structure that is at least one of: adjacent to the turbine or in which the turbine is positioned.

3. The apparatus of claim 2, wherein the support gantry is configured to mount to opposing sides of the casing in which the turbine is positioned and an exhaust hood adjacent to the turbine.

4. The apparatus of claim 1, wherein the support gantry includes a plurality of adjustable support members configured to accommodate a plurality of different turbines.

5. The apparatus of claim 1, wherein the vertically extending arm is length adjustable.

6. The apparatus of claim 5, further comprising a vibrating assembly including a vibratory drive mechanism coupled to the vertically extending arm.

7. An apparatus configured for at least one of removing or installing a turbine blade from a turbine of a turbomachine while the turbine is positioned within a casing of the turbomachine, wherein the turbine is housed in the casing while the turbine is operation and during use of the apparatus, the apparatus comprising:

an operative head configured to engage an axial sidewall of a turbine blade base while the turbine is positioned within the casing;

a linear actuator that is configured to selectively move the operative head to selectively engage the axial sidewall of the turbine blade base and impart an axial force against the turbine blade base for the at least one of removing or installing the turbine blade;

a mount member supporting the linear actuator;

a slide system connected to the mount member, the operative head, and the linear actuator, whereby the slide system is configured to slidably move the operative head relative to the mount member responsive to the linear actuator to apply the axial force;

a support gantry to which the mount member is attached, wherein the support gantry is capable of positioning the linear actuator substantially vertically above the turbine blade while the turbine is positioned within the casing, wherein the operative head includes an arm operatively coupled to the linear actuator; and a coupler by which the mount member is attached to the support gantry, whereby the coupler is configured to selectively position the mount member between:

a first state in which the mount member is axially and pivotally fixed to an axially-extending support member of the support gantry and the arm is configured to extend substantially vertically adjacent a first stage of a plurality of turbine blade stages, and a second state in which the mount member is pivotable relative to the axially-extending support member to position the arm radially outside of any turbine blade on the turbine, and axially movable along the axially-extending support member of the support gantry, and wherein, in the second state, the linear actuator is movable along the axially-extending support member for positioning relative to a different second stage of the plurality of turbine blades.

8. The apparatus of claim 7, wherein the support gantry is configured to mount to a portion of the turbomachine in which the turbine blade is positioned, the support gantry configured to mount to the casing in which the turbine is positioned for the removing or installing a turbine blade, the portion of the turbomachine including a structure that is at least one of: adjacent to the turbine or in which the turbine is positioned.

9. The apparatus of claim 8, wherein the support gantry is configured to mount to opposing sides of the casing in which the turbine is positioned and an exhaust hood adjacent to the turbine.

10. The apparatus of claim 8, wherein the support gantry includes a plurality of adjustable support members configured to accommodate a plurality of different turbines.

11. The apparatus of claim 7, wherein the vertically extending arm is length adjustable.

12. The apparatus of claim 11, further comprising a vibrating assembly including a vibratory drive mechanism coupled to the vertically extending arm.

13. The apparatus of claim 11, wherein the operative head is configured to engage the axial sidewall of the turbine blade base.

* * * * *